US011840876B2

(12) United States Patent
Raynal et al.

(10) Patent No.: US 11,840,876 B2
(45) Date of Patent: Dec. 12, 2023

(54) ASSEMBLY OF AUTOMATIC GATES INCLUDING SUBSTANTIALLY IDENTICAL MOTOR ASSEMBLIES AND METHOD FOR PRODUCING SUCH AN ASSEMBLY

(71) Applicant: Revenue Collection Systems France SAS, Plessis Pate (FR)

(72) Inventors: Christophe Raynal, Bretigny sur Orge (FR); Franck Lehner, Bretigny sur Orge (FR)

(73) Assignee: REVENUE COLLECTION SYSTEMS FRANCE SAS, Plessis Pate (FR)

( * ) Notice: Subject to any disclaimer, the term of this patent is extended or adjusted under 35 U.S.C. 154(b) by 27 days.

(21) Appl. No.: 16/634,535

(22) PCT Filed: Aug. 1, 2018

(86) PCT No.: PCT/EP2018/070847
§ 371 (c)(1),
(2) Date: Jan. 27, 2020

(87) PCT Pub. No.: WO2019/025482
PCT Pub. Date: Feb. 7, 2019

(65) Prior Publication Data

US 2020/0181977 A1 Jun. 11, 2020

(30) Foreign Application Priority Data

Aug. 1, 2017 (FR) ..... 17 00810

(51) Int. Cl.
*E06B 11/08* (2006.01)
*E05F 15/614* (2015.01)
*E05F 17/00* (2006.01)

(52) U.S. Cl.
CPC ..... *E06B 11/085* (2013.01); *E05F 15/614* (2015.01); *E05F 17/00* (2013.01); *E05Y 2400/415* (2013.01); *E05Y 2900/13* (2013.01)

(58) Field of Classification Search
CPC ..... E06B 11/085; E06B 11/08; E05F 15/614; E05F 17/00; E05F 17/004;
(Continued)

(56) References Cited

U.S. PATENT DOCUMENTS 732,982 A * 7/1903 Wendler ..... E05C 7/002 49/68
1,406,788 A * 2/1922 Weinmann ..... E05G 5/02 340/541
(Continued)

FOREIGN PATENT DOCUMENTS

CN 101871292 A 10/2010
FR 3015746 A1 6/2015
(Continued)

OTHER PUBLICATIONS

French Search Report issued in by the French Patent Office in corresponding Application No. FR 1700810, dated Mar. 23, 2018.
(Continued)

*Primary Examiner* — Jerry E Redman
(74) *Attorney, Agent, or Firm* — ArentFox Schiff LLP

(57) ABSTRACT

This automatic gate assembly includes at least one first automatic gate and at least one second automatic gate. The or each first automatic gate includes a first frame defining a first passage, at least one first obstacle, chosen from the following obstacles: swing leaf, laterally sliding leaf, pivoting leaf, for selectively closing and opening the first passage, and a first motor assembly for moving the first obstacle. The or each second automatic gate includes a second frame defining a second passage, at least one second
(Continued)

obstacle, different to the first obstacle and chosen from the following obstacles: swing leaf, laterally sliding leaf, pivoting leaf, for selectively closing and opening the second passage, and a second motor assembly for moving the second obstacle. The first and second motor assemblies are substantially identical to each other.

1 Claim, 5 Drawing Sheets

(58) Field of Classification Search
CPC ..... E05Y 2400/415; E05Y 2900/13; E05Y 2800/176; G07C 9/20; G07C 9/00
USPC ..... 49/49, 42
See application file for complete search history.

(56) References Cited

U.S. PATENT DOCUMENTS 3,314,198 A * 4/1967 Frisk ..... E04H 15/22 49/386
3,478,467 A * 11/1969 May ..... G07C 9/10 49/35
3,602,350 A * 8/1971 Collins ..... G07F 17/145 194/239
3,606,698 A * 9/1971 Tanaka et al. ..... G07C 9/15 49/35
4,060,039 A * 11/1977 Lagarrigue ..... G01V 3/10 109/3
4,308,803 A * 1/1982 Pretini ..... E06B 3/903 109/21
4,586,441 A * 5/1986 Zekich ..... E05G 5/02 109/6
5,195,448 A * 3/1993 Sims ..... E05G 5/02 109/6
5,311,166 A * 5/1994 Frye ..... G08B 15/00 340/552
5,694,867 A * 12/1997 Diaz-Lopez ..... E05G 5/003 109/6
5,711,111 A * 1/1998 Nyffenegger ..... E06B 3/90 49/44
5,878,529 A * 3/1999 Huber ..... E05F 15/71 49/31
6,308,644 B1 * 10/2001 Diaz ..... E05G 5/003 109/6
7,617,974 B2 * 11/2009 Vandyck ..... G07C 9/10 235/382
8,020,603 B2 * 9/2011 Burgin ..... G07C 9/10 160/134
8,695,276 B2 * 4/2014 Zhang ..... E05F 15/00 49/49
9,285,325 B2 * 3/2016 Gray ..... G01N 23/04
9,891,314 B2 * 2/2018 Morton ..... G01S 13/87
9,922,515 B2 * 3/2018 Hoy ..... G08B 15/02
10,021,350 B2 * 7/2018 Rayner ..... G06T 7/00
10,378,268 B2 * 8/2019 Portilla ..... B05B 12/122
11,047,099 B2 * 6/2021 Hosokawa ..... E01F 13/06
11,053,729 B2 * 7/2021 Romero ..... E06B 3/90
11,326,387 B2 * 5/2022 Osann, Jr. ..... E05F 15/646
2002/0050098 A1 * 5/2002 Chan ..... E06B 11/08 49/42
2010/0223850 A1 * 9/2010 Chen ..... E06B 11/085 49/49
2012/0090239 A1 * 4/2012 Hondius ..... E06B 3/90 49/27

FOREIGN PATENT DOCUMENTS

GB 2305204 A 4/1997
WO WO 97/21898 A1 6/1997
WO WO 2004/059591 A2 7/2004
WO WO 2006/013277 2/2006

OTHER PUBLICATIONS

International Search Report issued by the International Search Authority in corresponding International Application No. PCT/EP2018/070847, dated Oct. 2, 2018.

* cited by examiner

ASSEMBLY OF AUTOMATIC GATES INCLUDING SUBSTANTIALLY IDENTICAL MOTOR ASSEMBLIES AND METHOD FOR PRODUCING SUCH AN ASSEMBLY

CROSS-REFERENCE TO RELATED APPLICATIONS

This application is a National Stage entry of International Application No. PCT/EP2018/070847, filed on Aug. 1, 2018, which claims priority to French Patent Application No. 1700810, filed on Aug. 1, 2017. The disclosures of the priority applications are hereby incorporated in their entirety by reference.

BACKGROUND OF THE INVENTION

The present invention relates to an automatic gate assembly, of the type including at least one first automatic gate and at least one second automatic gate, the or each first automatic gate including:

- a first frame defining a first passage,
- at least one first obstacle, chosen from the following obstacles: swing leaf, laterally sliding leaf, pivoting leaf, for selectively closing and opening the first passage, and
- a first motor assembly for moving the first obstacle, the or each second automatic gate including:

- a second frame defining a second passage,
- at least one second obstacle, different from the first obstacle and chosen from the following obstacles: swing leaf, laterally sliding leaf, pivoting leaf, for selectively closing and opening the second passage, and
- a second motor assembly for moving the first obstacle.

The invention also relates to a method for producing such an assembly.

Such automatic gate assemblies are typically configured to be used within access control systems for reserved areas such as pedestrian areas, the insides of buildings, public transportation networks, etc. They make it possible to filter users at the entrance, and if applicable, the exit of these reserved areas so as to limit access to said reserved areas only to authorized users. To that end, the obstacles of these automatic gates are typically positioned in a deployed position, in which they extend through an access passage to the reserved area, and moved by the motor assemblies of these automatic gates into a position retracted away from the passage when an authorized user arrives at the entrance of the passage.

The known automatic gates have a wide variety of types of obstacles, but here we more particularly examine gates whose obstacles are of the leaf type, that is to say, formed by moving panels. There are three major categories of leaves for the automatic gates:

- swing leaves, mounted pivoting relative to the frame around an axis parallel to the passage,
- laterally sliding leaves, mounted translatably relative to the frame along an arc of circle centered on an axis parallel to the passage, and
- pivoting leaves, mounted pivoting relative to the frame around a vertical axis.

Most often, each leaf is kinematically coupled to the motor assembly by an intermediate mechanical device that converts the rotational movement of the motor shaft at the output of the motor assembly into a movement of the leaf between its retracted and deployed positions. This intermediate mechanical device, generally formed by many parts, has a role of transmitting the movement and adapting the latter in terms of torque as well as speed and geometry. It also typically makes it possible to react forces that could not be borne by the output shaft of the motor assembly.

One drawback of these known solutions lies in the great diversity of the intermediate mechanical devices, this diversity in particular being related to the variety of the obstacles. This great diversity indeed makes the mechanical design of new gates complex, increases production costs, and makes it necessary to keep a large number of spare parts in inventory.

SUMMARY OF INVENTION

One aim of the invention thus consists of simplifying the mechanical design of new automatic gates. Other aims consist of reducing the production costs, and minimizing the number of spare parts needed.

To that end, according to a first aspect, the invention relates to a set of automatic gates of the aforementioned type, in which the first and second motor assemblies are substantially identical to one another.

"Substantially identical" means that the first and second motor assemblies have the same electromechanical design. The parts included in the composition of these motor assemblies can vary, however, to within any production allowances.

According to specific embodiments of the invention, the assembly of automatic gates also has one or more of the following features, considered alone or according to any technically possible combination(s):

- each of the first and second motor assemblies is made up of a gear motor;
- the gear motor includes a motor and an electronic board for controlling the motor, said electronic board being configurable;
- the first obstacle is made up of a swing leaf or a pivoting leaf, and the first motor assembly is directly coupled to the first obstacle;
- the first obstacle is made up of a swing leaf, said swing leaf including a rigid structure secured to an output shaft of the first motor assembly, a panel mounted on the rigid structure and, interposed between the panel and the rigid structure, a shock absorbing device able to deform resiliently in a direction parallel to the first passage;
- the second obstacle is made up of a laterally sliding leaf articulated to the second frame by means of an articulation parallelogram including at least two connecting rods that are substantially parallel to one another, each of said connecting rods being mounted pivoting relative to the second frame around a primary axis of rotation that is parallel to the second passage, and relative to the second obstacle around a secondary axis of rotation that is parallel to the second passage, the second motor assembly being coupled directly to one of the connecting rods of the articulation parallelogram; and
- the assembly includes at least one third automatic gate including:
  - a third frame defining a third passage,
  - at least one third obstacle, different from the first and second obstacles and chosen from the following obstacles: swing leaf, laterally sliding leaf, pivoting leaf, for selectively closing and opening the third passage, and a third motor assembly for driving the third obstacle, said third motor being substantially identical to the first and second motor assemblies.

Still according to the first aspect, the invention also relates to a method for producing an assembly of automatic gates, comprising the following steps:

providing at least one first motor assembly and at least one second motor assembly that are substantially identical to one another, providing at least one first door including a first frame defining a first passage and at least one first obstacle, chosen from the following obstacles: swing leaf, laterally sliding leaf, pivoting leaf, for selectively closing and opening the first passage, providing at least one second door including a second frame defining a second passage and at least one second obstacle, different from the first obstacle and chosen from the following obstacles: swing leaf, laterally sliding leaf, pivoting leaf, for selectively closing and opening the second passage, configuring the first motor assembly according to a first operating mode, configuring the second motor assembly according to a second operating mode, assembling the first motor assembly to the first door so as to form a first automatic gate, the first motor assembly moving the first obstacle, and assembling the second motor assembly to the second door so as to form a second automatic gate, the second motor assembly moving the second obstacle.

According to specific embodiments of the invention, the production method also has one or more of the following features, considered alone or according to any technically possible combination(s):

each of the first and second motor assemblies is made up of a gear motor;

the gear motor includes a motor and an electronic board for controlling the motor, said electronic board being configurable;

the first obstacle is made up of a swing leaf or a pivoting leaf, and the first motor assembly is, during the assembly step, directly coupled to the first obstacle;

the first obstacle is made up of a swing leaf, said swing leaf including a rigid structure secured to an output shaft of the first motor assembly, a panel mounted on the rigid structure and, interposed between the panel and the rigid structure, a shock absorbing device able to deform resiliently in a direction parallel to the first passage;

the second obstacle is made up of a laterally sliding leaf articulated to the second frame by means of an articulation parallelogram including at least two connecting rods that are substantially parallel to one another, each of said connecting rods being mounted pivoting relative to the second frame around a primary axis of rotation that is parallel to the second passage, and relative to the second obstacle around a secondary axis of rotation that is parallel to the second passage, the second motor assembly being, during the assembly step, coupled directly to one of the connecting rods of the articulation parallelogram; and the step for providing motor assemblies comprises providing at least one third motor assembly substantially identical to the first and second motor assemblies, the method further comprising the following additional steps:

providing at least one third door including a third frame defining a third passage and at least one third obstacle, different from the first and second obstacles and chosen from the following obstacles: swing leaf, laterally sliding leaf, pivoting leaf, for selectively closing and opening the third passage, configuring the third motor assembly according to a third operating mode, and assembling the third motor assembly to the third door so as to form a third automatic gate, the third motor assembly moving the third obstacle.

According to a second aspect independent from the first aspect, the invention also relates to an automatic gate including a frame defining a passage, at least one swing leaf for selectively closing and opening the passage, and a motor assembly for moving the swing leaf, wherein the motor assembly is made up of a gear motor directly coupled to the swing leaf.

According to one particular embodiment of the invention, this automatic gate also has the following feature:

the swing leaf includes a rigid structure secured to an output shaft of the motor assembly, a panel mounted on the rigid structure and, interposed between the panel and the rigid structure, a shock absorbing device able to deform resiliently in a direction parallel to the passage.

BRIEF DESCRIPTION OF DRAWINGS

Other features and advantages of the invention will appear upon reading the following description, provided solely as an example and done in reference to the appended drawings, in which.

DETAILED DESCRIPTION OF PREFERRED EMBODIMENT

Figure 1:
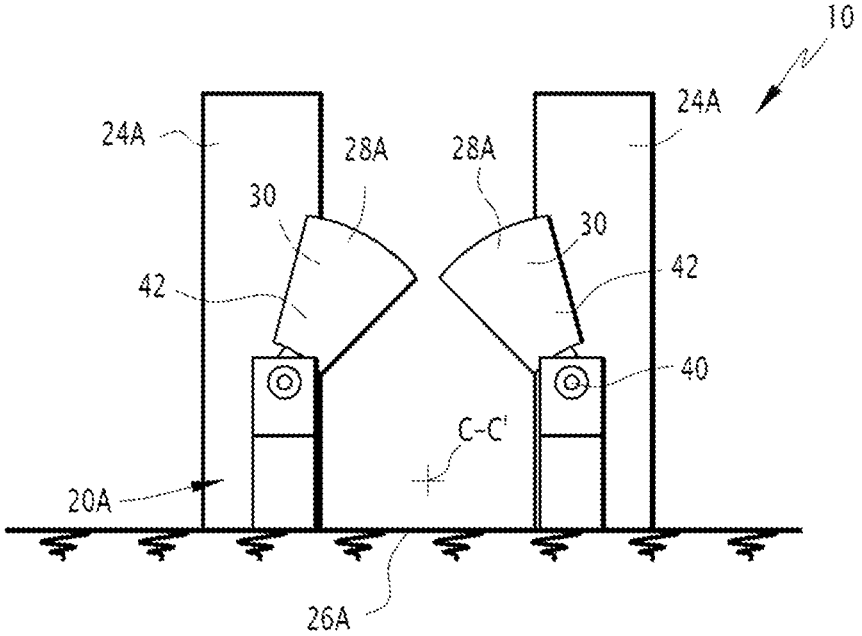
FIG. 1 is a front view of a first automatic gate of a gate assembly according to the invention.

The gates 10, 12, 14, shown in FIGS. 1 to 5, include a first automatic gate 10, a second automatic gate 12, and a third automatic gate 14. Each one includes a door, respectively 20A, 20B, 20C, and at least one motor assembly, respectively 22A, 22B, 22C.

For each gate 10, 12, 14, the door 20A, 20B, 20C includes a frame, respectively 24A, 24B, 24C, defining a passage, respectively 26A, 26B, 26C, extending along a longitudinal circulation axis C-C'. The door 20A, 20B, 20C also includes at least one obstacle, respectively 28A, 28B, 28C, mounted moving relative to the frame 24A, 24B, 24C between a deployed position, in which the obstacle 28A, 28B, 28C extends through the passage 26A, 26B, 26C, and a retracted position, in which the obstacle 28A, 28B, 28C is separated from the passage 26A, 26B, 26C. Preferably, each door 20A, 20B, 20C includes two obstacles 28A, 28B, 28C, as shown in the Figures.

For each gate 10, 12, 14, each obstacle 28A, 28B, 28C is made up of a leaf 30, 32, 34, that is to say, a panel moving relative to the frame 24A, 24B, 24C. This leaf 30, 32, 34 is chosen from the following list: swing leaf, laterally sliding leaf, pivoting leaf. It is different from the leaves 30, 32, 34 equipping the other gates 10, 12, 14; in other words, for each type of leaf listed in the aforementioned list, only one of the gates 10, 12, 14 is equipped with leaves of this type.

Figure 2:
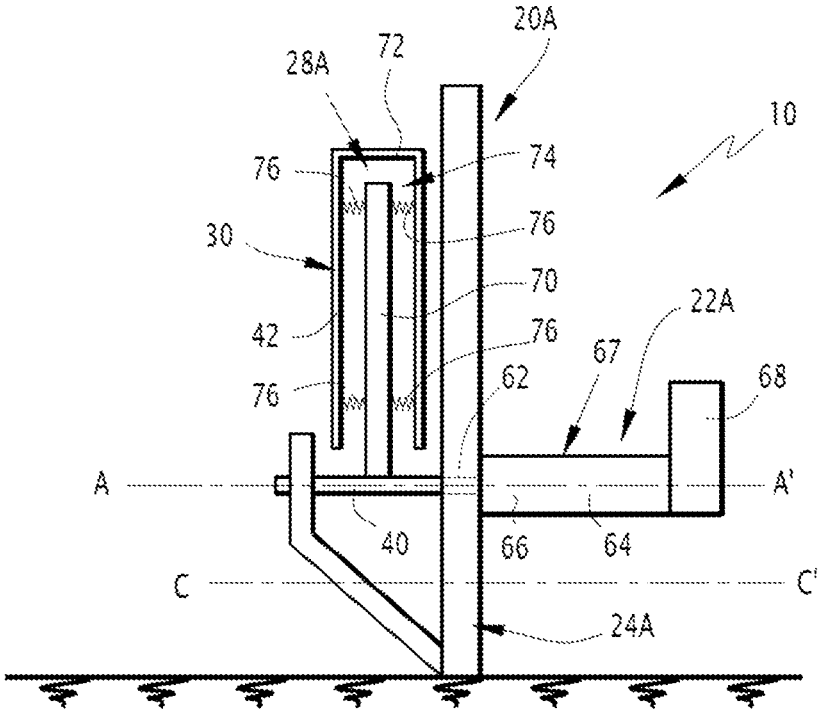
FIG. 2 is a schematic side view of the first automatic gate of FIG. 1.

In the case of the first gate 10, shown in FIGS. 1 and 2, each obstacle 28A is in particular made up of a swing leaf 30, that is to say, a leaf mounted pivoting relative to the frame 24A around a longitudinal axis of rotation A-A'. To that end, the leaf 30 is secured to a longitudinal shaft 40 mounted moving around its axis relative to the frame 24A.

The leaf 30 in particular includes a first section 42 in the shape of a disc sector centered on the axis A-A'. Optionally, the leaf 30 also includes a second section (not shown), also in the shape of a disc sector centered on the axis A-A', movable relative to the first section 42 between a position retracted inside the first section 42 when the leaf 30 is in the retracted position and a position deployed outside the first section 42 when the leaf 30 is in the deployed position.

Figure 3:
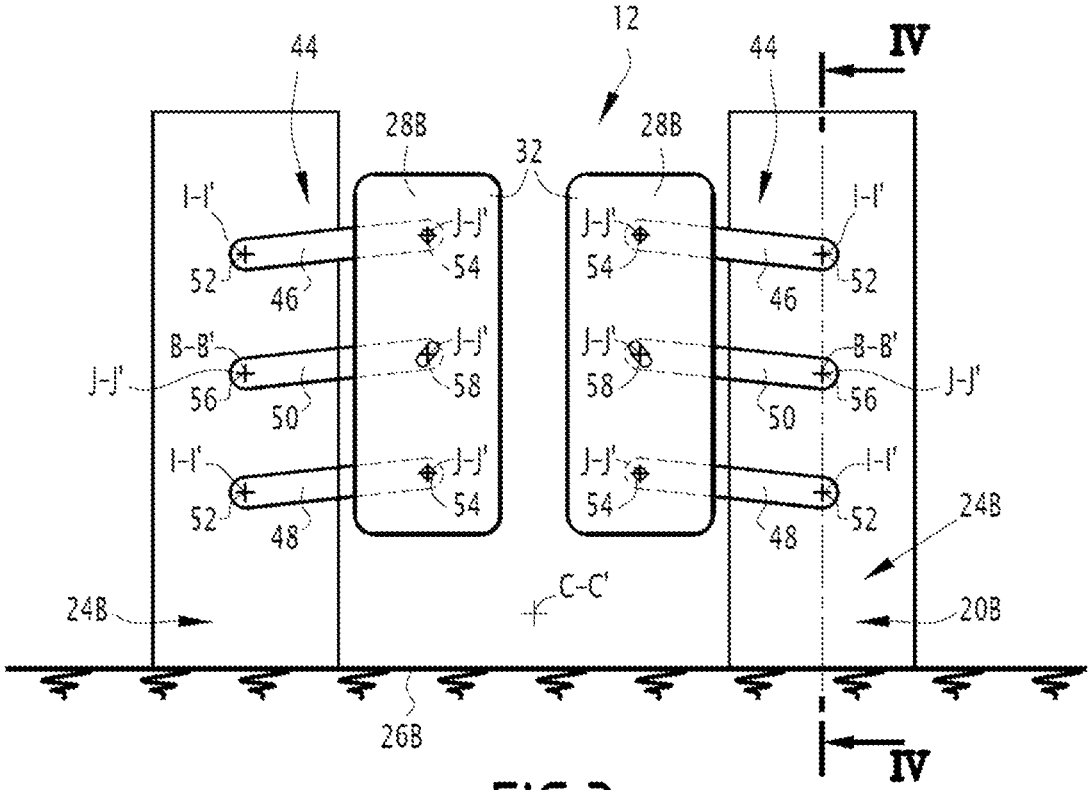
FIG. 3 is a front view of a second automatic gate belonging to the same gate assembly as the gate of FIG. 1.
Figure 4:
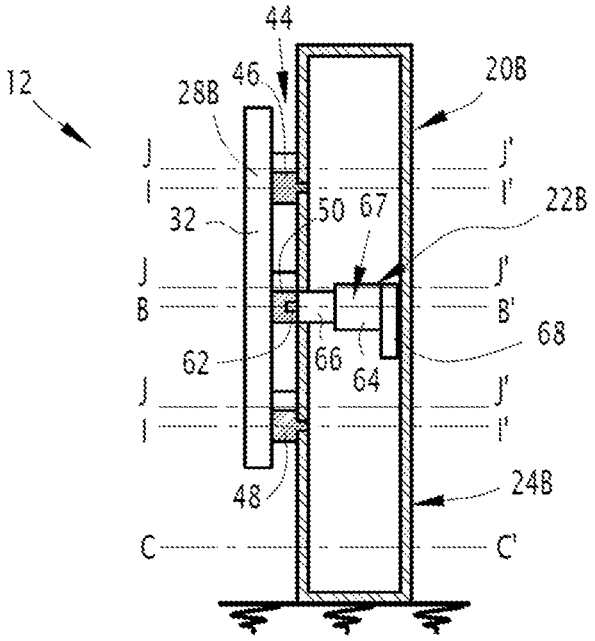
FIG. 4 is a partial sectional view of the automatic gate of FIG. 3, taken along the plane marked IV-IV in FIG. 3.

In the case of the second gate 12, shown in FIGS. 3 and 4, each obstacle 28B is made up of a laterally sliding leaf 32, that is to say, a leaf mounted translatably relative to the frame 24B along an arc of circle centered on a longitudinal axis B-B'. This axis B-B' is the axis on which the arc of circle is centered described by the center of gravity of the leaf 32 when the leaf 32 moves between its retracted and deployed positions.

To that end, the leaf 32 is articulated to said frame 24B by means of an articulation parallelogram 44.

This articulation parallelogram 44 includes, in a known manner, at least two connecting rods 46, 48, 50 that are substantially parallel to one another. Each of said connecting rods 46, 48, 50 is mounted pivoting around a primary longitudinal axis of rotation I-I' relative to the frame 24B and around a secondary longitudinal axis of rotation J-J' relative to the leaf 32. For each connecting rod 46, 48, 50, the distance between the primary I-I' and secondary J-J' axes of said connecting rod 46, 48, 50 is substantially equal to the distance between the primary I-I' and secondary J-J' axes of rotation of each other connecting rod 46, 48, 50. Furthermore, for each connecting rod 46, 48, 50, the distance from its primary axis of rotation I-I' to the primary I-I' axis of rotation of each other connecting rod 46, 48, 50 is substantially equal to the distance from its secondary axis of rotation J-J' to the secondary axis of rotation of said other connecting rod 46, 48, 50.

In the illustrated example, there are in particular three connecting rods 46, 48, 50. They include maintaining connecting rods 46, 48 and a driving connecting rod 50.

Each maintaining connecting rod 46, 48 is mounted to the frame 24B by means of a first pivot link 52 with axis I-I'. It is also mounted to the leaf 32 by means of a second pivot link 54 with axis J-J'.

The driving connecting rod 50 is in turn mounted to the frame 24B by means of a pivot link 56 with axis I-I', and to the leaf 32 by means of a pivot link with axis J-J' associated with a guideway 58 in a direction orthogonal to that of the pivot J-J', and preferably approximately orthogonal to the force applied by the connecting rod 50 when the leaf 32 is midway between its retracted and deployed positions. The driving connecting rod 50 is in particular interposed between the maintaining connecting rods 46, 48.

Figure 5:
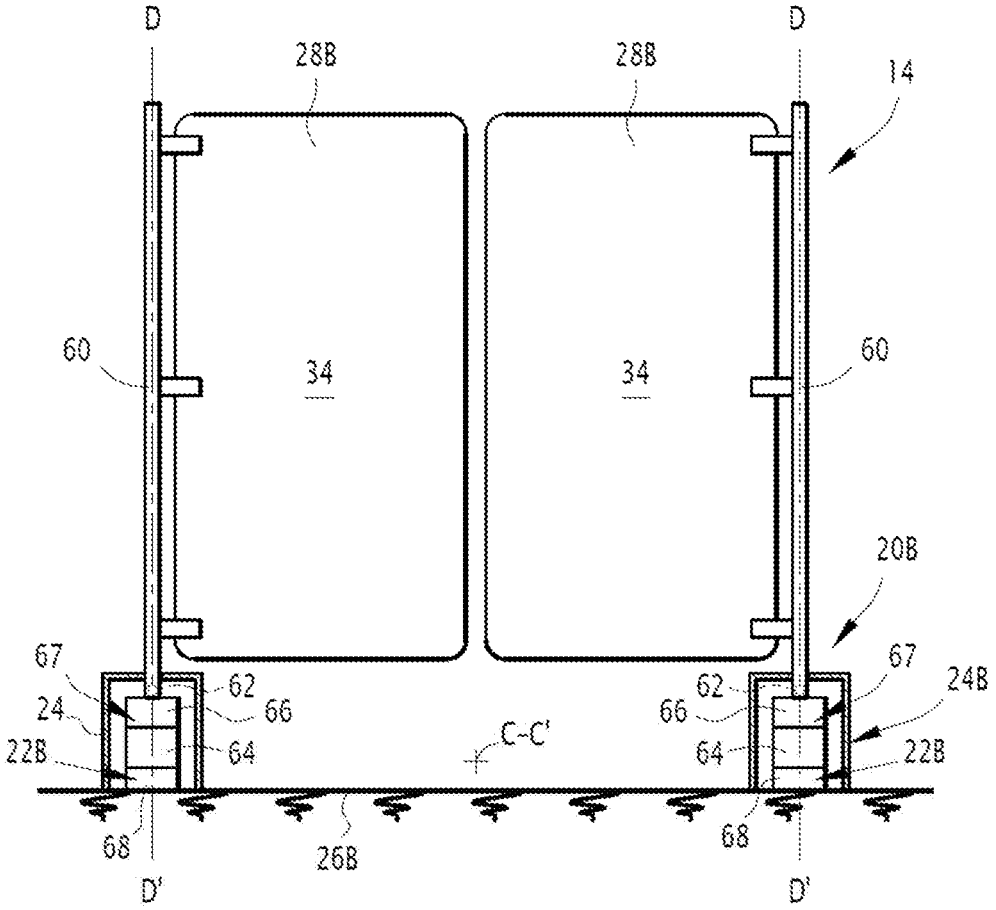
FIG. 5 is a front view of a third automatic gate belonging to the same gate assembly as the gates of FIGS. 1 and 2.

In the case of the third gate, shown in FIG. 5, each obstacle 28C is made up of a pivoting leaf 34, that is to say, a leaf mounted pivoting relative to the frame 24C around a vertical axis of rotation D-D'. To that end, the leaf 34 is secured to a vertical shaft 60 mounted moving around its axis relative to the frame 24C.

The door 20A, 20B, 20C of each gate 10, 12, 14 also includes, in a known manner, a device (not shown) for checking access authorizations of the users arriving at the entrance of the passage 26A, 26B, 26C and controlling the motor assembly 22A, 22B, 22C. Such a device typically includes a ticket reader suitable for communicating with an access ticket of a user, and a control module program to command or not command the activation of the motor assembly 22A, 22B, 22C as a function of the data read by the ticket reader in a memory of the access ticket.

Each gate 10, 12, 14 includes a motor assembly 22A, 22B, 22C for each obstacle 28A, 28B, 28C. This motor assembly 22A, 22B, 22C is configured to move the obstacle 28A, 28B, 28C with which it is associated between its retracted and deployed positions.

To that end, the motor assembly 22A, 22B, 22C includes an output shaft 62 and a motor 64 for rotating the output shaft 62 around its axis, the output shaft 62 being kinematically linked to the obstacle 28A, 28B, 28C so that the rotation of the output shaft 62 around its axis moves the obstacle 28A, 28B, 28C between its retracted and deployed positions.

This motor assembly 22A, 22B, 22C is substantially identical for all of the gates 10, 12, 14. In other words, the motor assemblies 22A, 22B, 22C of the different gates 10, 12, 14 all have the same electromechanical design, the parts included in the composition of these motor assemblies 22A, 22B, 22C nevertheless being able to vary, to within any production allowances.

The motor assembly 22A, 22B, 22C also includes a reduction gear 66 reducing the rotation speed and increasing the torque between the rotor of the motor 64 and the output shaft 62, and an electronic board 68 for controlling the motor 64, said reduction gear 66 and said electronic board 68 forming, with the motor 64 and the shaft 62, a gear motor 67. The motor assembly 22A, 22B, 22C is in particular formed by this gear motor 67.

The electronic board 68 is programmed and configurable, that is to say, it is provided with executable software including algorithms based on parameters, at least part of which is modifiable in a data table stored in a rewritable memory of the board 68. These modifiable parameters typically include speeds, torques, rotation directions and/or governing constants in one or several positions of the rotor of the motor 64.

Preferably, the configuration of this electronic board 68 is different from one gate 10, 12, 14 to the other.

The motor assembly 22A, 22B, 22C is assembled to the gate 20A, 20B, 20C so as to minimize the intermediary mechanisms between the motor assembly 22A, 22B, 22C and the obstacle 28A, 28B, 28C.

To that end, the motor assemblies 22A, 22C of the first and third gates 10, 14 are each directly coupled to the obstacle 28A, 28B, 28C, that is to say, each one moves the shaft 40, 60 to which the obstacle 28A, 28B, 28C is secured without movement conversion between the movement of the output shaft 62 and the movement of said shaft 40, 60. Thus, in the case of the first gate 10, the output shaft 62 of the motor assembly 22A is coaxial to the shaft 40 and secured to the latter and, in the case of the third gate 14, the output shaft 62 of the motor assembly 22C is coaxial to the shaft 60 and secured to the latter.

Regarding the second gate 12, the motor assembly 22B is coupled directly to one of the connecting rods 46, 48, 50 of the articulation parallelogram 44, in particular to the driving connecting rod 50. Thus, the output shaft 62 of the motor assembly 22B is coaxial to the rotation axis I-I' of said connecting rod 50 and is secured to this connecting rod 50.

Furthermore, in the case of the first gate 10, each obstacle 28A is configured to absorb the longitudinal impacts that may be absorbed by the leaf 30.

To that end, the leaf 30 includes a rigid structure 70 secured to the shaft 40, a panel 72 mounted on the rigid structure 70 and, interposed between the panel 72 and the rigid structure 70, a shock absorbing device 74 able to deform resiliently in the longitudinal direction.

The shock absorbing device 74 is typically formed by a plurality of resilient members 76 each inserted between the panel 72 and the rigid structure 70, each resilient member 76 typically being formed by a sandwich of resilient strips (not shown) and rubber seals (not shown), the resilient strips and the rubber seals following one another in the longitudinal direction.

Figure 6:
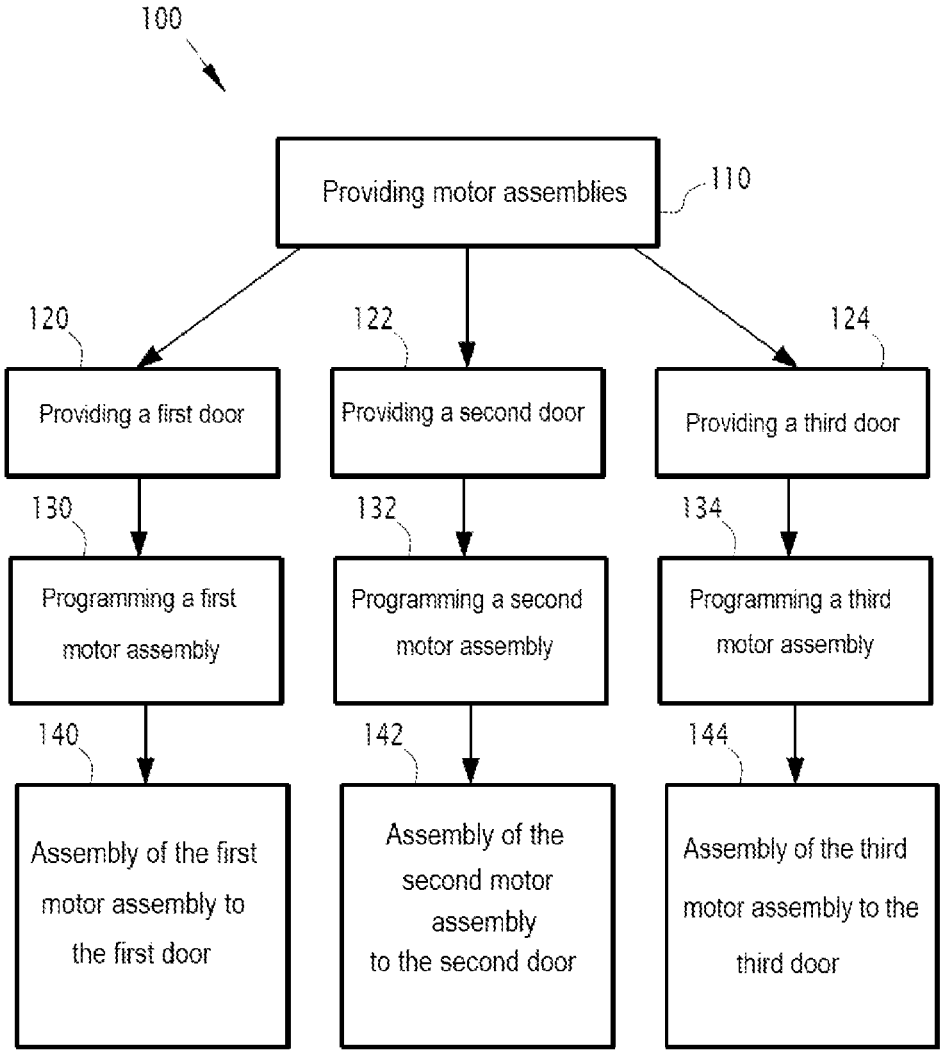
FIG. 6 is a flowchart illustrating a production method of the gate assembly to which the gates of FIGS. 1 to 5 belong.

A method 100 for producing the gate assembly 10, 12, 14 will now be described, in reference to FIG. 6.

First, during a first step 110, the motor assemblies 22A, 22B, 22C of the gates 10, 12, 14 are provided. As described above, these motor assemblies 22A, 22B, 22C are substantially identical to one another.

Next, during provision steps 120, 122, 124, the doors 20A, 20B, 20C of the gates 10, 12, 14 are provided. In particular, the door 20A of the gate 10 is provided equipped with swing leaves 30 during step 120, the door 20B of the gate 12 is provided equipped with laterally sliding leaves 32 during step 122, and the door 20C of the gate 14 is provided equipped with pivoting leaves 34 during step 124.

Then the motor assemblies 22A, 22B, 22C are configured each according to a specific operating mode during respective steps 130, 132, 134.

Lastly, the motor assembly 22A is assembled to the door 20A during a first assembly step 140 so as to form the first automatic gate 10, the motor assembly 22B is assembled to the door 20B during a second assembly step 142 so as to form the second automatic gate 12, and the motor assembly 22C is assembled to the door 20C during a third assembly step 144 so as to form the third automatic gate 14.

In particular, during the assembly step 140, the motor assembly 22A is coupled directly to the leaf 30, during the assembly step 142, the motor assembly 22B is coupled directly to the connecting rod 50, and, during the assembly step 144, the motor assembly 22C is coupled directly to the leaf 34.

In a variant (not shown), the motor assemblies 22A, 22B, 22C are configured after having been assembled to their respective door 20A, 20B, 20C, that is to say, the steps 130, 132, 134 take place after the steps 140, 142, 144.

Owing to the invention disclosed above, it is thus possible to minimize the number of spare parts necessary for the gates 10, 12, 14, since the intermediary mechanics for the transmission of movement between the output of each motor assembly 22A, 22B, 22C and the obstacle 28A, 28B, 28C that it moves are minimized.

Furthermore, the mechanical design of each gate 10, 12, 14 is simplified since, rather than having to design, for each gate 10, 12, 14, a transmission mechanism specific to said gate 10, 12, 14, it suffices to modify the configuration of the motor assembly 22A, 22B, 22C so as to adapt the rotation speed and the torque at the output of the motor assembly 22A, 22B, 22C as needed. This also allows a reduction in production costs.

It will be noted that the gate assembly according to the invention does not necessarily include a single first gate 10, a single second gate 12 and a single third gate 14, as disclosed above, but may include a plurality of each of the gates 10, 12, 14.

Figure 7:
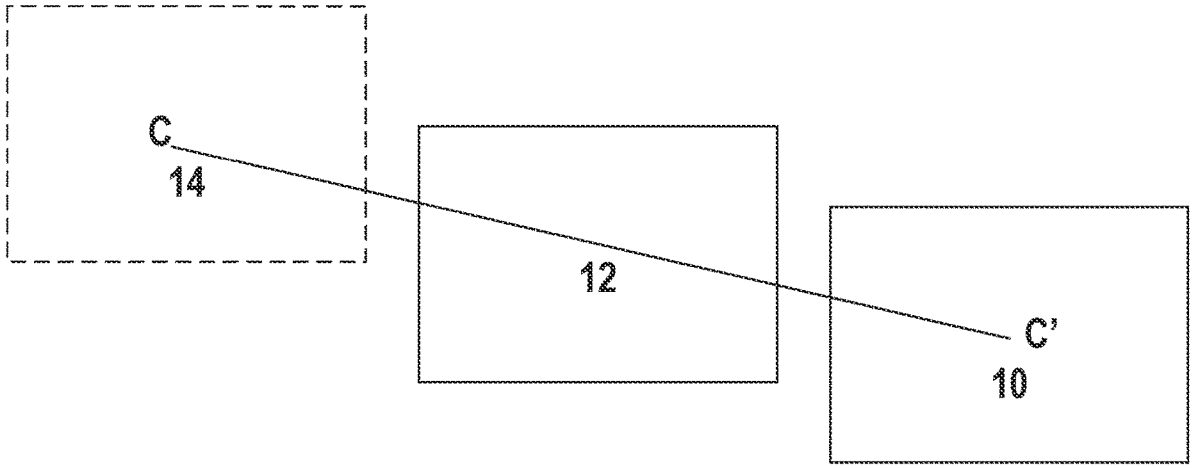
FIG. 7 is a view of the first automatic gate, the second automatic gate, and the third automatic gate along a longitudinal circulation axis C-C'.

FIG. 7 is a view of the first automatic gate 10, the second automatic gate 12, and the optional third automatic gate 14 along a longitudinal circulation axis C-C'.

The invention claimed is:

1. An automatic gate assembly along a single longitudinal axis including at least one first automatic gate and at least one second automatic gate, the at least one first automatic gate including:

a first frame defining a first passage along the single longitudinal axis, at least one first obstacle selectively closing and opening the first passage, the first obstacle consisting of an obstacle of a first type, the first type selected from a group consisting of: a swing leaf and a pivoting leaf, and a first motor assembly which moves the first obstacle, the first motor assembly being directly coupled to the first obstacle, wherein, when the first type comprises the swing leaf, the swing leaf including a rigid structure secured to an output shaft of the first motor assembly, a panel mounted on the rigid structure and, interposed between the panel and the rigid structure, a shock absorbing device able to deform resiliently in a direction parallel to the first passage, the at least one second automatic gate including:

a second frame defining a second passage along the single longitudinal axis, at least one second obstacle selectively closing and opening the second passage, the second obstacle consisting of an obstacle of a second type, different from the first type, the second type selected from the group consisting of: swing leaf, laterally sliding leaf, and pivoting leaf, and a second motor assembly which moves the second obstacle, wherein the first and second motor assemblies are substantially identical to each other, and wherein each of the first motor assembly and the second motor assembly is made up of a gear motor, wherein the gear motor includes a motor and an electronic board which controls the motor, the electronic board being configurable, and the configuration of the electronic board of the first automatic gate being different from the configuration of the electronic board of the second automatic gate.

* * * * *